US006290221B1

(12) United States Patent
Taniyama

(10) Patent No.: US 6,290,221 B1
(45) Date of Patent: Sep. 18, 2001

(54) SHEET STACKING/CONVEYING UNIT AND IMAGE FORMING APPARATUS USING SHEET STACKING/CONVEYING UNIT

(75) Inventor: Yoshiharu Taniyama, Kanagawa-ken (JP)

(73) Assignees: Toshiba Tec Kabushiki Kaisha, Tokyo; Kabushiki Kaisha Toshiba, Kawasaki, both of (JP)

( * ) Notice: Subject to any disclaimer, the term of this patent is extended or adjusted under 35 U.S.C. 154(b) by 0 days.

(21) Appl. No.: 09/352,765

(22) Filed: Jul. 14, 1999

(30) Foreign Application Priority Data

Jul. 14, 1998 (JP) ..... 10-198723
Jun. 29, 1999 (JP) ..... 11-183512

(51) Int. Cl.[7] ..... B65H 29/20

(52) U.S. Cl. ..... 271/3.14; 271/178; 271/182; 271/186; 271/220

(58) Field of Search ..... 271/184, 186, 271/3.14, 4.1, 178, 220, 182; 399/364, 373, 374

(56) References Cited

U.S. PATENT DOCUMENTS 582,593 * 5/1897 Waite .
1,019,158 * 3/1912 Ielfield .
2,844,373 * 7/1958 Van Marle ..... 271/87 X
3,342,481 * 9/1967 Kaplan ..... 271/71 X
4,552,351 * 11/1985 Tsukamoto ..... 271/3.1 X
4,591,142 * 5/1986 Divoux et al. ..... 271/196 X
5,613,673 * 3/1997 Roberts et al. ..... 271/182
6,089,565 * 7/2000 Voorhees et al. ..... 271/182

FOREIGN PATENT DOCUMENTS 62-275950 A * 11/1987 (JP) .
1-261161 A * 10/1989 (JP) .
10-268706 10/1998 (JP) .

* cited by examiner

*Primary Examiner*—Christopher P. Ellis
*Assistant Examiner*—Kenneth W Bower
(74) *Attorney, Agent, or Firm*—Foley & Lardner

(57) ABSTRACT

A sheet stacking and conveying unit that have a first end and a second end includes: a sheet stacker to stack sheets conveyed in the first direction in order; a conveyor to convey a lowest stacked sheet in the second direction that is opposite to the first direction by contacting the lower surface of the sheet; a sheet pressing member to apply a specified pressing force to a conveyor via a sheet by contacting the top of a sheet stacked in a stacker and a receiving portion provided to a sheet pressing member and to receive the first end of a sheet that is next stacked in a stacker. Further, this unit includes a driving mechanism that drives a sheet pressing member, drops a sheet received by a receiving portion on the top of a conveyor, clamps it between a conveyor and a sheet pressing member and receives a sheet that is next conveyed to a stacker by a receiving portion.

7 Claims, 6 Drawing Sheets

SHEET STACKING/CONVEYING UNIT AND IMAGE FORMING APPARATUS USING SHEET STACKING/CONVEYING UNIT

BACKGROUND OF THE INVENTION

1. Field of the Invention

The present invention relates to a sheet stacker/conveyor and an image forming apparatus using this sheet stacking/conveying unit, e.g., an electronic copying machine.

2. Description of the Related Art

General image forming apparatus such as electronic copying machines, printers, etc. incorporating an image forming unit in the inside are demanded to print images not only on the surfaces of sheets but also on the backs in many cases. So, a so-called automatic duplex sheet feeder is provided to stack sheets with images printed on the surface temporarily and then, convey these stacked sheets again to an image forming unit.

This automatic duplex sheet feeder is capable of printing both sides of a sheet by taking a sheet with an image printed on its surface in this unit, turning it over and conveying it again to an image forming unit.

In addition, this automatic duplex sheet feeder is also capable of printing both sides of a plurality of sheets by feeding a plurality of the surface printed sheets in order. Two systems are so far adopted for taking out a plurality of sheets in order.

As a first system, a plurality of sheets stacked in a stacker of an automatic duplex sheet feeder are fed in order from the top sheet. In this system, an image is first printed on the surface of a sheet and this sheet is once stacked in the stacker in this sheet feeder. In this case, the sheet with an image printed on its surface is stacked in order on a sheet with an image printed on the surface previously. Then, after completing the image printing on the surface of a last sheet, the image printing on the back starts from the last sheet with an image printed on its surface.

When printing an image on the back, sheets are fed in order from a highest sheet with an image printed on the last surface and an image is printed on the back. That is, an image is printed on the back in the sequence entirely reverse to the first image printing on the surface.

The printing according to a second system up to the step when a sheet with an image printed on the surface is next put over a sheet with an image printed on the back in the automatic duplex unit is the same. In the image printing on the back, a lowest sheet is taken out and fed for the image printing.

So, according to this type of system, a sheet with an image first printed on the surface is taken out of a stacker in the same sequence as when it was stacked in the stacker.

In the first system, that is in a system to make the image printing on the back by taking a top sheet with an image printed on the surface, productivity of the duplex printing is worse because the image printing on the back cannot be started unless the image printing on the surfaces of all sheet is completed.

In the second system, that is, in a system to make the image printing on the back by taking a lowest sheet with an image printed on the surface, it is possible to take out a sheet from the stacker for the image printing on the back without waiting the completion of the image printing on the surfaces of all sheets and productivity can be increased higher than the first system.

However, in the automatic duplex unit of the second system, it is necessary to perform the operation to stack sheets with an image printed on the surface in the duplex unit and the operation to feed sheets for the image printing on the back by taking them out of the stacker simultaneously and smoothly in order to maintain said high productivity.

So, there is so far available a unit that is able to take out sheets stacked in the automatic duplex unit from the lower surface side by a pick-up roller and immediately feed them for the image printing on the back. However, in such the structure, while sheets are taken out by the pick-up roller, other sheets with an image printed on the surfaces are conveyed to the sheet stacker successively. Therefore, a pressing force required to convey sheets could not be applied to the pick-up roller.

If a pressing force required cannot be applied to the pick-up roller, sheets cannot be surely conveyed and such problems as improper sheet feeding can be generated. In a conventional apparatus, as a countermeasure, such a construction is adopted that a sheet stacker is tilted so that stacked sheets could reach a sheet feed roller by their tare.

In this case, even when the conveying force of the pick-up roller is insufficient, it is possible to surely convey sheets to the sheet feeding roller. On the other hand, because a sheet stacker is tilted, an automatic duplex unit becomes a large size and the entire image forming apparatus becomes a large size accordingly.

SUMMARY OF THE INVENTION

It is an object of the present invention to provide an image forming apparatus that contributes to improve productivity of duplex printing and separation performance, stabilized sheet feeding by the certain sheet conveying and downsizing of an apparatus on the assumption that a sheet at the lowest position is taken out of sheets with an image printed on the surfaces in order to print both sides.

According to the present invention, a stacking and conveying unit of sheets having first and second ends is provided, which comprising a stacking portion configured to stack sheets conveyed in a first direction successively; a conveying portion provided in the stacking portion, kept in contact with a lower surface of the lowest stacked sheet and conveys the lowest stacked sheet in a second direction opposite to the first direction; a sheet pressing member in contact with a top of the sheets stacked in the stacking portion to apply a specified pressing force to the conveying portion via the sheets; a receiving portion provided on the sheet pressing member to received the first end of the sheet that is next stacked in the stacking portion; and a driving mechanism to rotate the sheet pressing member to put the sheet received by the receiving portion for clamping the received sheet between the conveying portion and the sheet pressing member, the receiving portion receives a sheet that is next stacked in the stacking portion.

Further, according to the present invention, an image forming apparatus having duplex sheet feeding means and image forming means for forming images on a first and a second surfaces of a sheet is provided, which comprising the duplex sheet feeding means including sheet stacking means for stacking sheets sequentially delivered after formed an image on the first surface of the sheet by the image forming means; sheet feeding means provided in the sheet stacking means for feeding a lowest stacked sheet by contacting its lower surface toward the image forming means to form an image on the second surface of the sheet; sheet pressing means in contact with the top of the sheets to be stacked in the sheet stacking means for applying a specified pressing force to the sheet feeding means via the sheet; a receiving portion provided to the sheet pressing means to receive a sheet that is next conveyed to the sheet stacking means; and driving means for rotating the sheet pressing means to put the sheet received by the receiving portion for clamping the received sheet between the sheet conveying means and the sheet pressing means, the receiving portion receives a sheet that is next stacked in the stacking means.

DETAILED DESCRIPTION OF THE PREFERRED EMBODIMENTS

Hereinafter, preferred embodiments of a sheet stacking/conveying unit and an image forming apparatus using this sheet stacking/conveying unit of the present invention are described.

Figure 1:
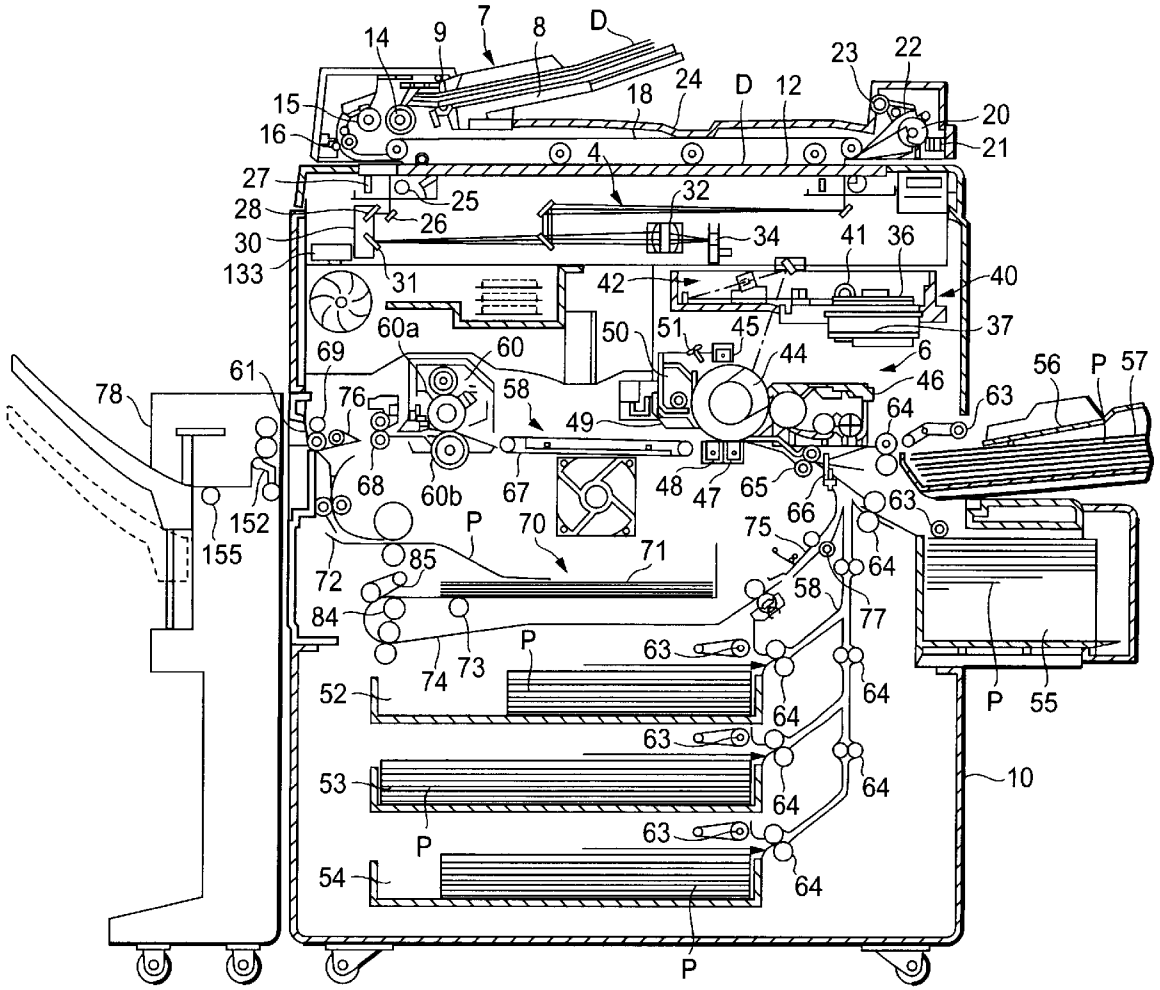
FIG. 1 is a schematic sectional view showing an image forming apparatus to which an automatic duplex unit of the present invention is applied.

As shown in FIG. 1, a digital copying machine is equipped with a main body 10 in which a scanner unit 4 that functions as a reader and a printer unit 6 are provided.

On the top of the main body 10, a document table 12 comprising a transparent glass on which a document D is placed is provide. Further, on the top of the main body 10, an automatic document feeder 7 (hereinafter, referred to as ADF) to automatically feed documents D on the document table 12 is arranged. The ADF 7 is arranged so that is can be opened/closed to the document table 12 and also function as a document cover to closely fit a document D placed on the document table 12 thereto.

The ADF 7 is provided with a document tray 8 on which document D are set, an empty sensor 9 to detect the presence of documents D, a pick-up roller 14 to pick-up document D by one sheet at a time, a sheet feed roller 15 to convey picked up documents D, aligning roller pair 16 to align the leading edge of documents D and a conveyor belt 18 that is provided so as to cover nearly the entire document table 12. A plurality of documents D that are set upward on the document tray 8 are picked up sequentially from the lowest page, that is, the last page and after aligned by the aligning roller pair 16, conveyed to a specified position on the document table 12 by the conveyor belt 18. At the end of the opposite side to the aligning roller pair 16 with the conveyor belt 18 interposed, a converting roller 20, a non-converting sensor 21, a flapper 22 and an outlet roller 23 are arranged. A document D from which image information is read by the scanner unit 4 is sent out from the document table 12 by the conveyor belt 18 is ejected on a document outlet portion 24 by way of the flapper 22 and the outlet roller 23. To red the back of a document D, when the flapper is changed over, the document D conveyed by the conveyor belt 18 is turned over by the converting roller 20 and conveyed again to a specified position on the document table 12 by the conveyor belt 18.

The scanner unit 4 arranged in the main body 10 has an exposure lamp 25 as a light source to illuminate a document D placed on the document table 12 and a first mirror 26 to deflect the reflecting light from the document D in the specified direction. The exposure lamp 25 and the first mirror 26 are mounted to a first carriage 27 that is provided below the document table 12.

The first carriage 27 is arranged movable in parallel to the document table 12 and is reciprocated under the document table 12 by a driving motor by way of a toothed belt (not shown) and the like.

Under the document table 12, there is arranged a second carriage 28 that is movable in parallel with the document table. Seconded and third mirrors 30 and 31 to deflect the reflecting light from a document D in order, that is deflected by the first mirror 26 are mounted to the second carriage 28 at a right angle each other. The second carriage 28 is moved following the first carriage 27 by the toothed belt, etc. to drive the first carriage 27 and is moved at an ½ speed of the first carriage 27 along the document table 12.

Further, under the document table 12, there are arranged a focusing lens 32 that focuses the reflected light from the third mirror 31 on the second carriage 28 and a CCD sensor 34 that receives and photoelectric transfers the reflected light focused by the focusing len 32. The focusing lens 32 is arranged movable via a moving mechanism in the surface including the optical axis of the light deflected by the third mirror 31 and focuses the reflected light at a desired magnification by moving itself. The CCD sensor 34 makes the photoelectric transfer of incident reflected light and outputs electric signals corresponding to read documents D. The electric signals corresponding to documents D are stored in an image storage (not shown) as image data.

The printer unit 6 is equipped with a laser exposing unit 40 as an exposing scanner. This laser exposing unit 40 is equipped with a semiconductor laser 41 as a light source, a polygonal mirror 36 as a scanner member that continuously deflects the laser beam emitted from the semiconductor laser 41, a polygonal mirror driving motor 37 to drive the polygonal mirror 36 at a specified number of revolutions and an optical laser system 42 to deflect the laser beam from the polygonal mirror 36 and lead to a photosensitive drum 44. The laser exposing unit 40 in such structure is fixed to and supported by a supporting frame (not shown) of the main body 10.

The semiconductor laser 41 is turned ON/OFF according to image data, etc. of documents D that are read by the scanner unit 4. The laser beam is directed to the photosensitive drum 44 via the polygonal mirror 36 and the optical laser system 42 in the laser exposing unit 40 and by scanning the circumferential surface of the photosensitive drum 44, forms an electrostatic latent image on the circumferential surface of the photosensitive drum 44.

The printer unit 6 has the photosensitive drum 44 that is rotatably provided as an image carrier at nearly the center of the main body. The photosensitive drum 44 is exposed by the laser beam from the laser exposing unit 40 while rotating in the sub-scanning direction and an electrostatic latent image is thus formed. Around the photosensitive drum 44, a main charge 45 to charge the circumferential surface of the photosensitive drum 44 to a specified potential, a developing unit 46 to develop an electrostatic latent image formed on the circumferential surface of the photosensitive drum 44 by supplying a toner as a developer and a transfer charger 47 to transfer a toner image formed on the photosensitive drum 44 on a sheet P supplied from a paper cassette that is described later are provided in order. Further, a separation charger 48 that is incorporated into one unit with the transfer charger 47 to separate a sheet P from the photosensitive drum 44, a separation claw 49 to separate a sheet P from the circumferential surface of the photosensitive drum 44, a cleaner unit 50 to clean residual toner left on the photosensitive drum 44 and a charge eliminator to eliminate charge left on the photosensitive drum 44 are arranged in order.

At the lower part in the main body 10, an upper cassette 52, a middle cassette 53 and a lower cassette 54 than can be pulled out of the main body 10, respectively are provided in the mutually stacked state. In each of these cassettes, sheets P in different size are loaded and at the sides of these cassettes, a large volume sheet feeder 55 is provided. In the large volume sheet feeder 55, sheets P in size of highly using frequency, for instance, A4 size sheets P of about 3000 sheets are housed. Above the large volume sheet feeder 55, a sheet cassette 57 that is also used as a manual sheet feed tray 56 is detachably mounted.

In the main body 10, a conveyor path 58 extending from each cassette and the large volume sheet feeder 55 through a transfer portion located between the photosensitive drum 44 and the transfer charger 47 is formed. At the end of the conveyor path 58, there is provided a fixing unit 60 that is composed of a heat roller 60*a* having a built-in fixing lamp and a pressure roller 60*b* press fitted to this heat roller 60*a*. On the side wall of the main body 10 opposing to the fixing unit 60, an output port 61 is formed and a finisher 78 of a single tray is mounted to the outlet port 61.

Near the upper cassette 51, the middle cassette 53, the lower cassette 54, the sheet cassette 57 and the large volume sheet feeder 55, a pick-up roller 63 is provide to each of the cassette or the large volume sheet feeder to pick up sheets P by one sheet at a time. The conveyor path 58 is provided with a large number of sheet feed roller pair 64 to convey sheets P picked up by the pick-up roller 63 along the conveyor path 58.

On the conveyor path 58, at the upper stream side of the photosensitive drum 44, a register roller pair 65 is provided. The register roller pair 65 corrects the tilt of a picked up sheet P, aligns the leading edge of a toner image on the photosensitive drum 44 with the leading edge of a sheet P and conveys a sheet P to the transfer portion at the same speed as the moving speed of the circumferential surface of the photosensitive drum 44. In front of the register roller pair 65, that is, at the sheet feed roller pair 64 side, a sensor 66 is provided to detect the arrival of a sheet P.

In the transfer portion, a developer image, that is, a toner image formed on the photosensitive drum 44 is transferred on a sheet P by the transfer charger 47. The sheet P having a transferred toner image is separated from the circumferential surface of the photosensitive drum 44 by the actions of the separation charger 48 and the separation claw 49 and conveyed to the fixing unit 60 by way of the conveyor belt 67 that is a part of the conveyor path 58. Then, after a developer image is fused and fixed on the sheet P by the fixing unit 60, the sheet P is ejected on the finisher 78 through the outlet port 61 by a sheet feed roller pair 68 and an outlet roller pair 69.

Under the conveyor path 58, there is provided an automatic duplex unit (hereinafter, referred to as ADU) which turns a sheet P passed through the fixing unit 60 over and feeds it again to the register roller pair 65.

The ADU 70 is provided with a sheet stacker 71 to stack a sheet P temporarily, a converting path 72 branched from the conveyor path 58 to convert a sheet P passed through the fixing unit 60 and lead to the sheet stacker 71, a pick-up roller 73 to pick-up sheet P stacked in the sheet stacker 71 by one sheet at a time and a conveying roller 77 to convey the picked up sheet P to the register roller pair 65 along a conveying path for duplex printing 74 and a conveying guide path 75. Further, a switching gate 76 to selectively sort sheets P to the outlet port 61 or the converting path 72 is provided at the branching portion of the conveyor path 58 and the converting path 72.

When making the duplex copying, a sheet P with an image formed on the front surface and passed through the fixing unit 60 is led to the converting path 72 by the switching gate 76 and conveyed to the ADU 70.

In the ADU 70, sheet P led by the converting path 71 are stacked in the sheet stacker 71 in order and the lowest sheet P of those sheets P stacked in the sheet stacker 71 is taken out by the pick-up roller 73. The taken out sheet P is conveyed to the register roller pair 65 through the conveying path for duplex printing 74 and the conveying guide path 75. Then, after aligned by the register roller pair 65, the sheet P is again conveyed to the transfer portion and a toner image is printed on the back of the sheet P. Thereafter, the sheet P is ejected on the finisher 78 through the conveyor path 58, the fixing unit 60 and the outlet roller pair 69.

Figure 2:
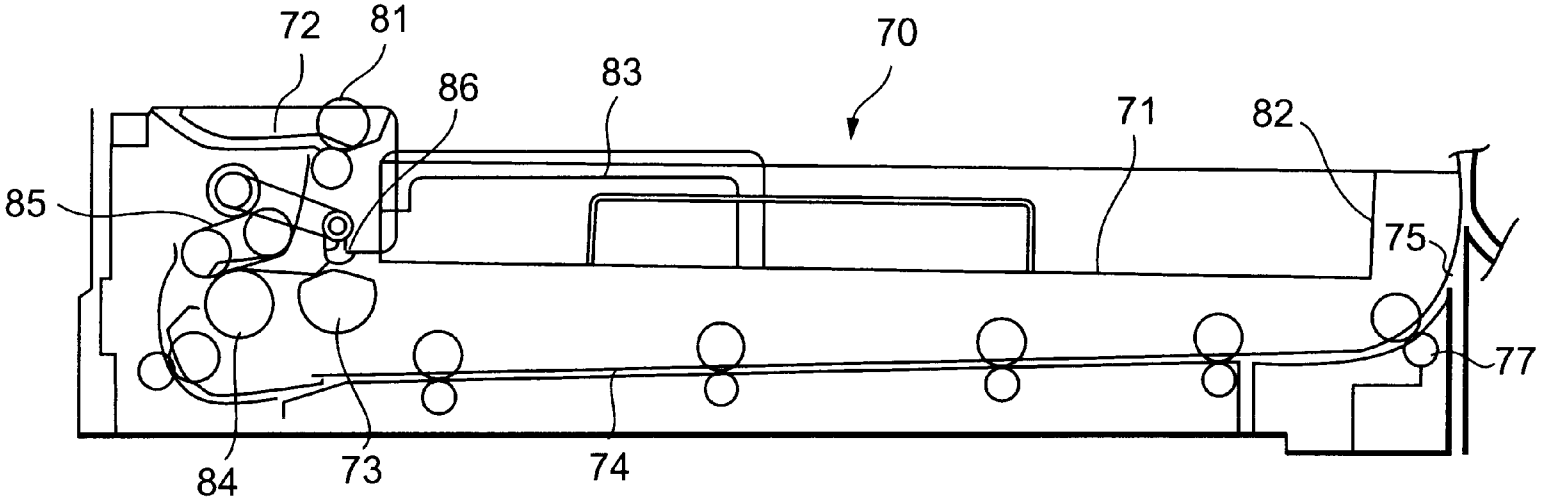
FIG. 2 is a front view of an automatic duplex unit incorporated in an image forming apparatus shown in FIG. 1.

Next, an ADU 70 that is a sheet stacking/conveying unit is described in detail referring to FIG. 2. The ADU 70 is equipped with the converting path 72 and an inverting roller pair 81 that is rotatable in the normal and reverse directions, opposing to the other end of the converting path 72. At the side of normal rotating direction of this inverting roller pair 81, the sheet stacker 71 is provided. A sheet with an image printed and fixed on the front surface is conveyed from the converting path 72 to the sheet stacker 71.

On one side of the sheet stacker 71, there are provided an end guide 82 that moves in the lengthwise direction of a sheet P being conveying according to its size and a pair of side guides 83 that move in the cross direction of a sheet P being moved according to its size and contacts its both side ends. Sheets P that are stacked in the sheet stacker 71 are aligned by these end guide 82 and a pair of side guides 83. That is, the end guide 82 and the pair of side guides 83 are so arranged that they are automatically moved according to a size of sheet P to be printed.

Here, for convenience, the trailing edge of a sheet P in the moving direction is called a first end, the leading edge is called as a second end and both edges are called as a third and a fourth ends. In other words, the second end of a sheet P comes in contact with the end guide 81, the first end is received by a receiving portion 86*a* of a pressing gate 86 that is described later, and the third and the fourth ends are aligned by the pair of side guides 83 and stacked in the sheet stacker 71.

At the under surface of the sheet stacker 71, there is arranged the pick-up roller 73 that conveys, that is, feeds a lowest sheet P out of sheets P stacked in the sheet stacker 71 by contacting its under surface. In the sheet feeding direction of this pick-up roller 73, there are arranged a sheet feed roller 84 and a separation belt 85 in the mutually contacting state.

In the sheet feeding direction of the sheet feed roller 84 and the separation belt 85, there is provided the conveying path for duplex printing 74 to convey and guide a sheet P along and in parallel with the under surface of the sheet stacker 71 by returning it.

Opposing to the pick-up roller 73, the pressure gate 86 comprising a sheet pressing means is provided. This pressure gate is described later.

Figure 3:
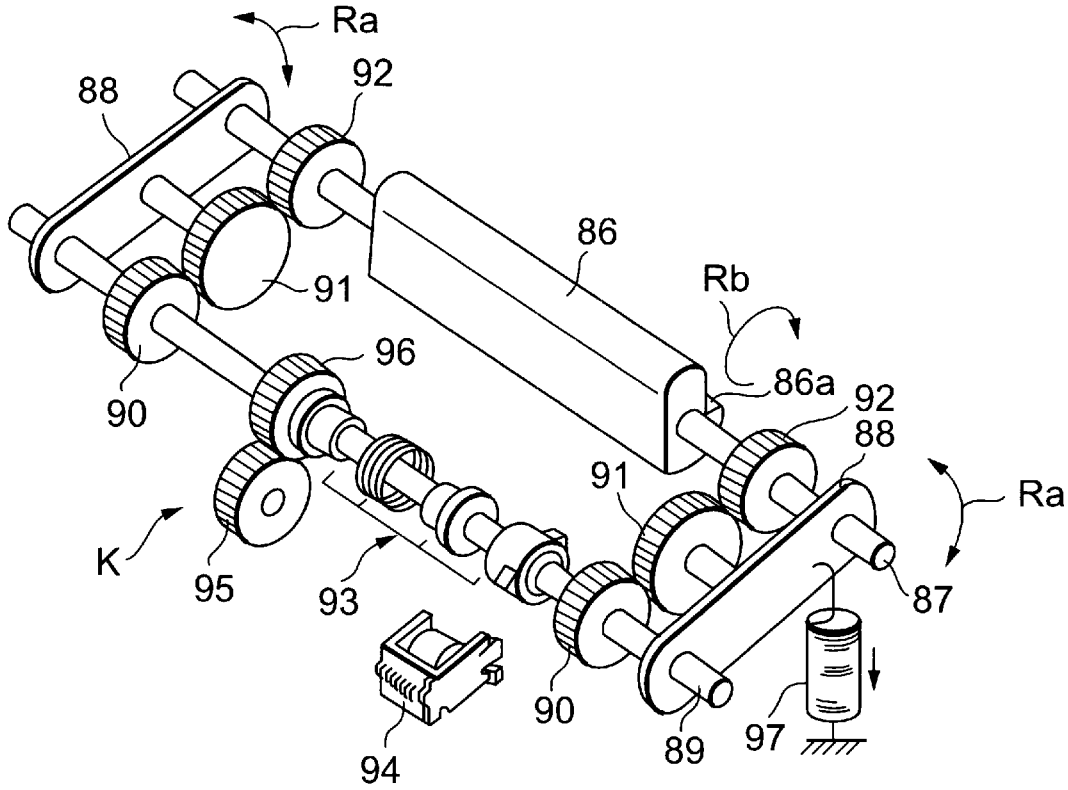
FIG. 3 is a perspective view showing a pressing gate of an automatic duplex unit shown in FIG. 2 and its driving mechanism.

As shown in FIG. 3 and FIG. 4, the pressing gate 86 has a rotating shaft 87 fitted to its one end and is rotated by the rotation of the rotating shaft 87. At the other end of the pressing gate 86, a receiving portion 86*a* that is formed in a hook shape is provided.

As shown in FIG. 3, both ends of the rotating shaft 87 are supported rotatably by one end of rotating levers 88. At the other end of the rotating levers 88, a driving shaft 89 is penetrated and united in one unit. Therefore, the pressing gate 86 is mounted to the free end of the rotating levers 88 together with the rotating shaft 87 and is able to rotate centering around the driving shaft 89.

Driving gears 90 are mounted to both sides of the driving shaft 89. These driving gears 90 are engaged with driven gears 92 mounted to both sides of the rotating shaft 87 via idle gears 91 that are mounted at the middle portions of the rotating levers 88.

That is, with the rotation of the driving gears 90, the driven gears 92 are rotated via the idle gears 91 and the rotating shaft 87 and the pressing gate 86 which are in one unit with this driven gears 92 are rotated as shown by an arrow-mark Ra.

The driving shaft 89 is provided with a rotating clutch 93, which controls the rotation of the pressing gate 86 by a solenoid 94. Further, at nearly the central portion of the driving shaft 89, a sub-driving gear 96 that engages with a main driving gear 95 which is fitted to the rotating shaft of a driving source (not shown).

A driving mechanism K of the pressing gate 86 is thus constructed by the gears and solenoid described above.

Further, if a pressing force of the pressing gate 86 applied to the pick-up roller 73 via a sheet P is insufficient as described later, it may be better to attach an elastic body, for instance, a pressure spring 97 to the rotating levers 88 or a weight may be attached.

Next, the operation when performing the duplex printing of sheets will be explained.

First, a sheet with an image printed on its front surface is let to the converting path 72 after the image is fixed by the fixing unit. The sheet P led to the converting path 72 is conveyed to the sheet stacker 71 by the inverting roller pair 81 and stacked in this sheet stacker 71.

Further, the conveying route for stacking a sheet P in the sheet stacker 71 of the ADU 70 after coming out of the fixing unit 60 is formed in the U-turn shape. Thus, an image formed on the upper side of a sheet P opposing to the photosensitive drum 44 comes to the lower side of the sheet in the sheet stacker 71.

The pick-up roller 73 comes in contact with the lower surface of the lowest sheet P in the sheet stacker 71, takes it out of the sheet stacker 71 and conveys in the direction of the sheet feed roller 84 and the separation belt 85. Each sheet P is separated and led to the conveying path for duplex printing 74.

The sheet P conveying route is formed in the U-turn shape from the sheet stacker 71 to the conveying path for duplex printing 74 and therefore, the image printed surface on the lower surface side of a sheet in the sheet stacker 71 comes again to the upper surface side of the sheet P on the conveying path for the duplex printing.

The sheet P passes through the conveying guide path 75 from the conveying path for duplex printing 74 and is again led to the photosensitive drum 44 by the register roller pair 65. As the conveying guide path 75 is facing the vertical direction, the image printed surface on the upper side of the sheet P in the conveying path for duplex printing 74 changes to the left side in the conveying guide path 75.

The conveying guide path 75 is curved toward the left side in front of the register roller pair 65 and then, runs in the horizontal direction and the sheet P is led to the photosensitive drum 44. The image printed surface of the sheet P comes to the lower side in the state facing the photosensitive drum 44.

Accordingly, the upper surface side of the sheet P having no printed image faces the photosensitive drum 44 and an image is newly printed on this surface.

Next, the actions when there are even number of documents having data to be printed on one side only, for instance, 6 sheets and one sheet is demanded for the duplex printing will be explained.

By stacking documents with the first document at the top and the sixth document at the bottom, set all documents on the ADF 7 and depress the duplex copy button.

In this ADF 7, the documents are sequentially sent out from the lowest sixth document and read by the scanner unit 4 from the last document to the first document, that is, in order of the sixth, fifth, fourth, third, second and first documents, and the read image data are stored in an image storage (not shown).

While the documents are scanned from the lowest sixth document, the stored image data is read in order of the last document to the first document every other document, that is, in order of the sixth, fourth and second document, and images corresponding to these image data are printed on the surfaces of 3 sheets, respectively.

The sheets with images printed on the surfaces are conveyed to the ADU 70 via the converting path 72 and stacked in order of the sixth, fourth and second document image sheets in the sheet stacker 71. Accordingly, the sixth document image sheet is placed at the lowest position and the second document image sheet comes to the highest document.

When the scanner unit reads all documents, it is judged whether the number of documents is an even number. Then, the stored image data is read and images corresponding to the image data on every other documents from the document that is one sheet before the last document, that is, in order of the fifth, third and first documents are formed on the photosensitive drum.

At this time, a sheet P with an image already printed on its surface is fed to the photosensitive drum 44 from the ADU 70. As explained previously, the sheets P stacked in the sheet stacker 71 are conveyed from the lowest sheet, they are supplied to the photosensitive drum 44 in order of the sixth, fourth and second document image printed sheets.

Accordingly, the fifth document image is transferred on the back of the sixth document image printed sheet from The photosensitive drum 44 and conveyed to the finisher 78 in the duplex printed state and put over the previously conveyed sheets.

Lastly, the first document image is transferred and printed on the back of the second document image printed sheet from the photosensitive drum 44 and conveyed from the finisher 78 n the duplex printed state and put over the previously conveyed sheets.

When all sheets P are ejected on the finisher 78, the first document image is formed on the upper surface of the highest sheet and the second document image is formed on the back of this sheet. The third document image is formed on the surface of next sheet P and the fourth document image is formed on the back of this sheet. Then, the fifth document image is formed on the surface of the lowest sheet P and the sixth document image is formed on the back of this sheet.

Figures 5A, 5B:
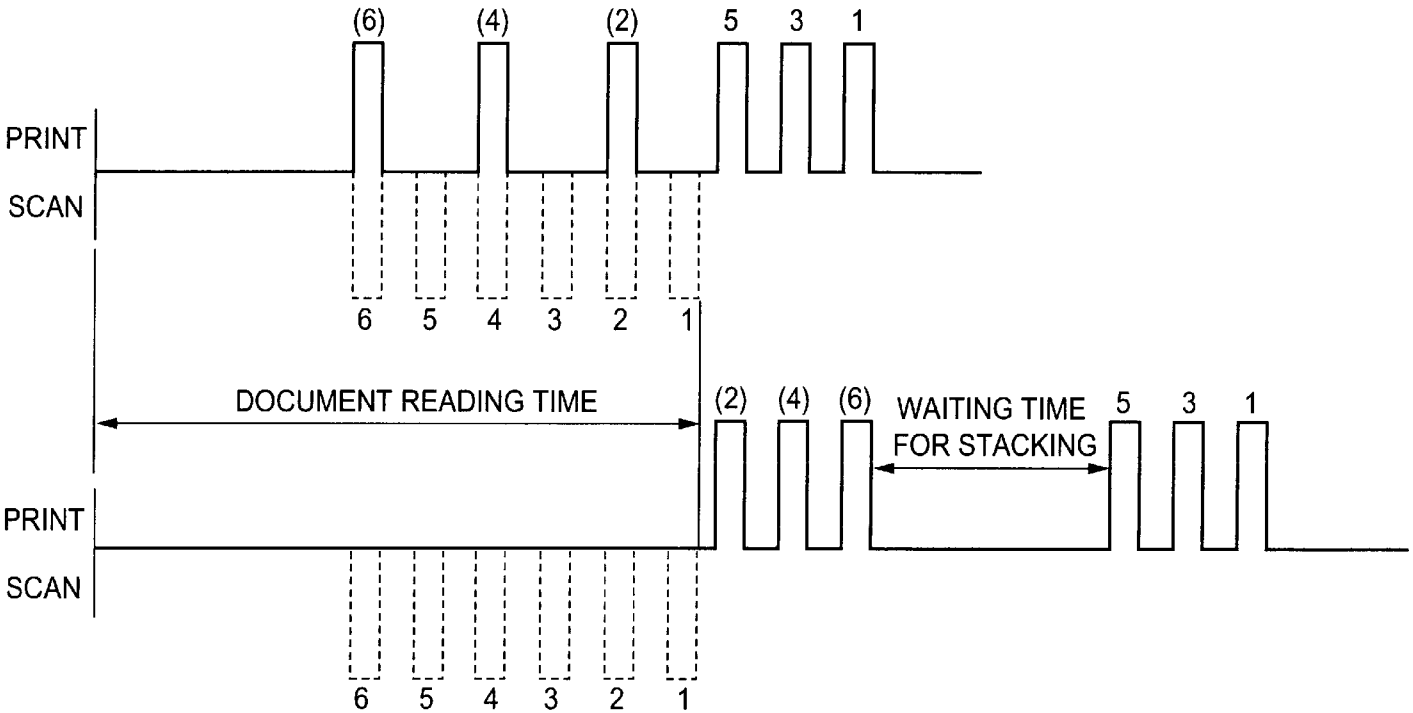
FIG. 5A and 5B are charts for comparing timing at the duplex copying of an image forming apparatus of the present invention with that of a conventional image forming apparatus.

As shown in the timing chart on FIG. 5A, on this electronic copying machine, images on the sixth, fourth and second documents are printed on the surfaces of sheets P simultaneously with the reading and the printed sheets are stored in the ADU 70.

When all documents are read, the stored sheets P are immediately supplied to the photosensitive drum 44 for the image printing on the backs and images of the fifth, third and first documents are printed on the backs. As there is no time stacking in the ADU 70 from the completion of the image printing on the surfaces to the start of the image printing on the backs, productivity in the duplex printing increases greatly.

On the contrary, as shown in FIG. 5B, on a conventional electronic copying machine, according to the copy timing under the same conditions, after reading all documents, image are printed on the surfaces of the second, fourth and sixth document in that order and the sheets are stored in the ADU.

In the ADU, until all required sheets are stored, the machine is put in the standby state. Then, the sheets are supplied from the ADU to the photosensitive drum for the image printing on the backs and the fifth, third and first document images are printed on the backs of the sheets.

Accordingly, on a conventional electronic copying machine, a time for document reading plus a time required for the duplex printing are needed and furthermore, a stack waiting time is required before starting the image printing on the backs of sheets after completing the image printing on the sheet surfaces. So, when an image forming apparatus of the present invention is adopted, the total copy time can be sharply reduced.

Next, the actions when there are single face documents in odd numbers, for instance, 5 sheets and one copy of duplex printing is demanded will be explained.

By stacking documents with the first document at the top and the fifth document at the bottom, set all documents on the ADF 7 and depress the start buttom. The documents are sent out in order from the fifth document at the bottom and read in order of the fifth, fourth, third, second and first documents, and image data of them are stored in the image storage portion.

While the documents are scanned from the lowest fifth document, images are formed from image data on every other document from the last document; that is, the fifth, third and first document in that order and images are printed on the surfaces of three sheets.

These sheets P are conveyed to the ADU 70 and image sheets P with the fifth document image, third document image and first doucment images printed, respectively are stacked in the sheet stacker 71 in that order. Accordingly, the fifth document image sheet with the image printed on the surface comes to the bottom and the first document image sheet P comes to the top.

When all documents are read, it is judged that the number of all documents is an odd number. Therefore, the optical laser system 42 forms images from the stored image data in order of every other documents starting from the document one sheet before the last document, that is, in order of the fourth document and the second document.

At this time, the document image sheets P stacked in the sheet stacker 71 of the ADU 70 are taken out from the last sheet P, that is, in order of the fifth, third and first document image sheets P.

The sheet P that is first supplied to the photosensitive drum 44 of the image forming portion has the fifth document image formed on the under surface side and this sheet P passes through the transfer portion and an image is not printed. The fourth document image is printed on the back at the top side of the third document image sheet that is conveyed next and similarly, the second document image is printed on the back of the first document image sheet.

The sheet P with the top fifth document image printed is again let into the ADU 70. The rotating direction of the inverting roller pair 81 of this ADU 70 is not changed and the sheet P is sent into the sheet stacker 71. When detecting the trailing edge of the sheet, the control portion controls to rotate the switching gate 76 so as to open the conveying path toward the finisher 78 and reverse the inverting roller pair.

By the action of the inverting roller pair 81, the sheet P is conveyed by reversing its trailing edge to the leading edge. The new leading edge of this sheet P is guided by the switching gate 76 and the sheet if ejected on the finisher 78 through the outlet port 61.

Accordingly, the fifth document image is on the under surface side of the sheet until the sheet is led to the converting path 72 but when it is converted on this converting path 72, the fifth document image comes to the upper surface side.

Thus, the sheet with the fourth and the third document images printed on both sides is led to the ADU 70 via the converting path 72 and when the trailing edge of the sheet is detected, the switching gate is displaced. At the same time, the inverting roller pair 81 is inverted, conveys and ejects the sheet, and the third document image comes to the upper surface side and the fourth document image comes to the under surface side and the sheet is put on the previously conveyed sheets.

Similarly, the sheet with the second and the first document images printed on both sides is led to the ADU 70 through the converting path 72, and the sensor (not shown) detects the trailing edge of the sheet and the switching gate 76 is displaced. At the same time, the inverting roller pair 81 is reversed and the first document image comes to the upper surface side and the second document image comes to the under surface side of the sheet. Under this state, the sheet is put over the previously conveyed sheets.

Although not specifically shown in the drawing, according to the timing chart in this case, the images on the front surfaces of the fifth, third and first documents are printed on the sheets P simultaneously with the reading and the sheets P are stacked in the ADU 70.

Accordingly, immediately after all documents are read, the sheets P can be supplied for the image printing for the backs from the ADU 70. As a result, productivity in the duplex printing greatly increases.

Thus, if the number of documents can be confirmed, regarding the subsequent copying, the same control as that of even number of documents becomes applicable and the reversing and ejecting operations become unnecessary.

Further, as the sheets once stacked in the ADU 70 are taken out from the lowest sheet P for the image printing on the back, the stacked sheets can be fed to the photosensitive drum 44 of the image forming portion without waiting the completion of stacking of all required sheets P. Further, documents can be stacked in the ADU 70 without waiting the completion of reading of all documents.

so, it is required to simultaneously perform the stacking and convey sheets P in the ADU 70. In other words, it is necessary to completely separate sheets P to be stacked and sheets P to be feed again to the photosensitive drum 44 of the image forming portion.

The pressing gate 86 in the ADU 70 and its driving mechanism previously explained in FIG. 2 and FIG. 3 surely perform the separation of the sheets P.

The pressing gate 86 is located at a position opposing to the pick-up roller 73 and retains the pressing force required for conveying sheets. In other words, the required pressing force is obtained by a tare composed of weights of the pressing gate 86 with the driving shaft 89 as the revolving center and the rotating levers 88 and the pressing force of the pressure springs 97 hooked on the rotating levers 88.

When the sheets P conveyed by the inverting roller pair 81 are stacked in the sheet stacker 71, the leading edges and both edges of the sheets are guided to the pre-set positions by an end guide 82 and side guides 85.

Figure 4C:
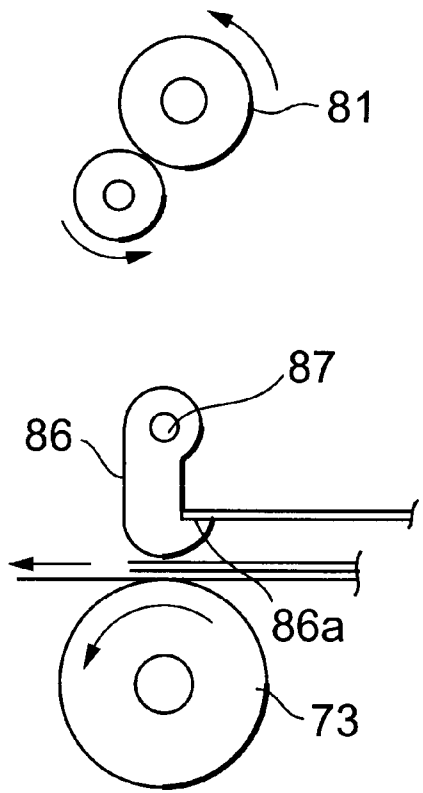
FIGS. 4A through 4C are schematic diagrams sequentially showing actions of a pressing gate shown in FIG. 3.
Figure 4B:
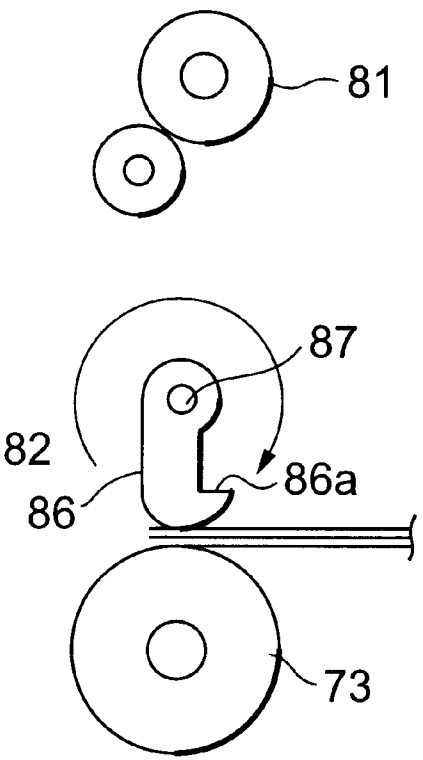
Figure 4A:
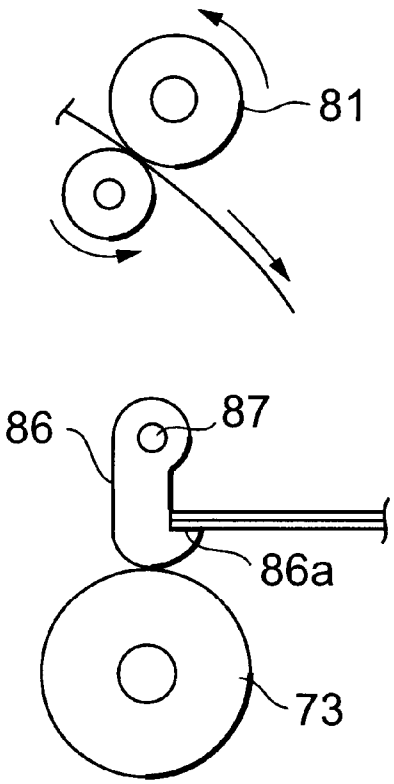

As shown in FIG. 4A, at this time, the ends of the pressing gate 86 is in contact with the pick-up roller 73 and the trailing edges of the sheets P are placed on a receiving portion 86*a* projecting to the lower end of the pressing gate 86. As the leading edges are brought in contact with the end guide 82, the trailing edges of the sheets P are positioned and accurately placed on the receiving portion 86*a*.

As shown in FIG. 4B, the pressing gate 86 is rotated clockwise by one turn by driving the driving mechanism of the pressing gate 86. When the pressing gate 86 is rotated at an even slight angle, a stacked sheet on the receiving portion 86*a* slips down therefrom and put on the pick-up roller 73.

When the pressing gate 86 is rotated by one turn and the receiving portion 86*a* is again positioned at the lower side as shown in FIG. 4B, the position of the pressing gate 86 is replaced and this lower end comes on a sheet P.

That is, the sheet end is clamped by the pressing gate 86 and the pick-up roller 73. Furthermore, the tare of the pressing gate 86 and the pressing force of the pressure springs 97 are applied to the clamped sheet P.

As shown in FIG. 4C, when taking out a sheet P by rotating the pick-up roller 73 for the image printing on the back of the sheet, as a specified pressing force is applied to the sheet P clamped between the pressing gate 86 and the pick-up roller 73, the pick-up roller 73 surely takes out the lowest sheet P.

And, when a new sheet is led to the ADU 70 through the converting path 72, the leading edge of this sheet contacts the end guide 82 and at the same time, the trailing edge is put on the receiving portion 86*a* of the pressing gate 86. Therefore, a sheet P taken out by the pick-up roller 73 is free from any intervention.

Further, after stacking a plurality of sheets P in the sheet stacker 71 and placing on the receiving portion 861 of the pressing gate 86, all of the sheets P may be clamped between the pressing gate 86 and the pick-up roller 73 by rotating the pressing gate 86 by one turn.

Thus, if the number of stacked sheets increases, the thickness of the entire sheets between the pressing gate 86 and the pick-up roller 73 increases. By predicting such the state, the pressing gate 96 is made in such structure that it is supported rotatably with the driving shaft 89 as a supporting point by the rotating shaft 87 and the rotating devices 88.

That is, even when the number of stacking sheets increases and a space between the pressing gate 86 and the pick-up roller 73 increases, a specified pressing force is applied to the sheets P clamped there without fluctuating. So, reliability of the sheet take-out remains unchanged.

Figure 7:
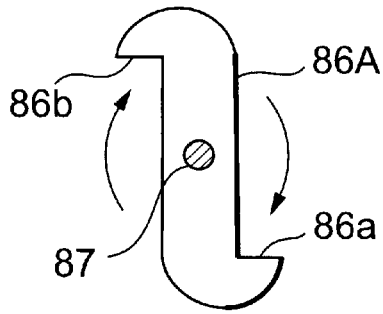
FIG. 7 is a front view showing a pressing gate in another embodiment of the present invention.

Further, the sectional shape of the pressing gate 86 is explained as that it has the receiving portion 86*a* at one end and rotates clockwise by one turn centering around the supporting point at the other end; however, it is not restricted to this. As shown in FIG. 7, it may be the pressing gate 86A that is provided with the receiving portions 36*a* and 36*b* in the same shape at both ends and the rotating center at the middle portion.

That is, the receiving portions 86*a* and 86*b* are projecting in the opposite directions each other and make the same action as the explained previously by rotating the pressing gate 86A by a half turn at a time.

As explained previously, in the system to feed a plurality of sheets stacked in the ADU of a conventional electronic copying machine sequentially from the top of them, unless all sheets are stacked in the stacker of the ADU, next back printing cannot be started and productivity of the duplex printing was worse.

On the contrary to this, in an image forming apparatus of the present invention, it becomes possible to make the printing on the backs sequentially from stacked sheets without waiting the completion of stacking of a plurality of sheets and productivity of the duplex printing is improved.

Furthermore, in an image forming apparatus of the present invention, in combination with an automatic document feeder, the reading of documents and stacking of them in the ADU 70 can be made at the same time and therefore, productivity is further improved.

The comparison of productivity of the duplex printing of a conventional electronic copying machine with an image forming apparatus using an ADU of the present invention is explained in the following referring to FIG. 6A and FIG. 6B.

Figures 6A, 6B:
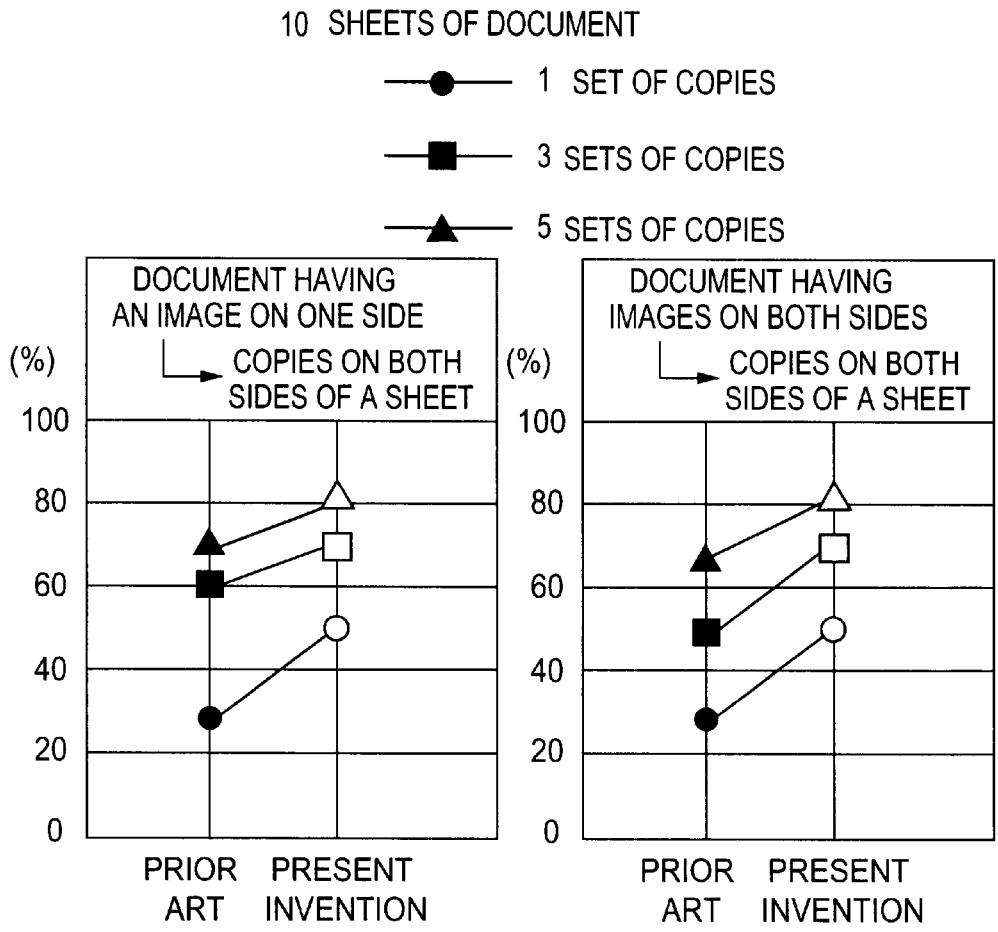
FIG. 6A and 6B are graphs comparing productivity at the duplex copying of an image forming apparatus of the present invention with that of a conventional image forming apparatus.

FIG. 6A is a graph showing the comparison of productivity when obtaining duplex copies from single surface documents. As shown in FIG. 6A, when one copy is obtained for 10 sheets of documents, productivity of a conventional system is only about 30%. On the contrary, when an automatic duplex unit that is a sheet stacking/conveying unit of the present invention is used, productivity is improved to about 70%. When 3 copies are obtained for 10 sheets of documents, productivity is about 60% in a conventional system, while productivity is improved to about 70% if an automatic duplex unit of the present invention is used. When 5 copies are obtained for 10 sheets of documents, productivity of a conventional system is about 70, while productivity is improved to about 80% if an automatic duplex unit of the present invention is used.

FIG. 6B is a graph showing the comparison of productivity when duplex printed copies from duplex image documents. As shown in FIG. 6B, when one copy of sheets is obtained for 10 sheets of documents, productivity of a conventional system is about 30%, while it is improved to about 50% if an automatic duplex unit that is a sheet stacking/conveying unit of the present invention is used. When 3 copies are obtained for 10 sheets of documents, productivity of a conventional system is about 50%, while it is improved to about 70% if an automatic duplex unit of the present invention is used. To obtain 5 copies for 10 sheets of documents, productivity of a conventional system is about 70%, while it is improved to about 80% if an automatic duplex unit of the present invention is used.

As explained in the above, according to the present invention, on the assumption that a duplex sheet feeding unit to take out the lowest sheet out of the sheets with images printed on the surface for the duplex printing is provided, productivity of the duplex printing and sheet separation performance were improved. Further, there are such effects that sheets are stably fed as they are certainly conveyed, thus contributing to the downsizing and cost reduction of an apparatus.

What is claimed is:

1. An image forming apparatus having duplex sheet feeding means and image forming means for forming images on a first and a second surfaces of a sheet, the image forming apparatus comprising:

the duplex sheet feeding means comprising:

sheet stacking means for stacking sheets sequentially delivered after forming of an image on the first surface of the sheet by the image forming means;

sheet feeding means provided in the sheet stacking means for feeding a lowest stacked sheet by contacting the lowest stacked sheet's lower surface toward the image forming means to form an image on the second surface of the sheet;

sheet pressing means in contact with the top of the sheets to be stacked in the sheet stacking means for applying a specified pressing force to the sheet feeding means via the sheet;

a receiving portion provided to the sheet pressing means to receive a sheet that is next conveyed to the sheet stacking means; and driving means for rotating the sheet pressing means to put the sheet received by the receiving portion for clamping the receiving sheet between the sheet feeding means and the sheet pressing means, the receiving portion receives a sheet that is next stacked in the stacking means.

2. An image forming apparatus according to claim 1, wherein the stacking means includes an end member provided so as to receive a first end of the sheet on the receiving portion when a second end of the sheet is brought in contact with the end member.

3. An image forming apparatus according to claim 1, wherein the sheet pressing means includes one end that is kept rotatably and the other end formed in a hook shape so that the first end of the sheet can be placed thereon.

4. An image forming apparatus according to claim 1, wherein the sheet pressing means includes one end formed in a hook shape so that the first end of the sheet is placed thereon, the other end formed in a hook shape so that the first end of the sheet is placed thereon, and a rotating shaft provided between the one end and the other end.

5. An image forming apparatus according to claim 1, wherein the driving means includes:

a rotating shaft holding the sheet pressing means rotatably;

a pair of rotating levers holding one end and the other end of the rotating shaft;

a driving shaft holding the pair of rotating levers rotatably;

a driving source for rotating the driving shaft; and springs to press the sheet pressing means toward the direction of the sheet feeding means.

6. An image forming apparatus according to claim 4, wherein the one end is projecting in the first direction and the other end is projecting in the second direction that is opposite to the first direction.

7. An image forming apparatus having an automatic duplex unit and an image forming unit that forms images on a first and a second surfaces of a sheet, the image forming apparatus comprising:

the automatic duplex unit comprising:

a sheet stacker that stacks sheets sequentially delivered after having an image formed on the first surface of the sheet by the image forming unit;

sheet feeding unit provided in the sheet stacker for feeding a lowest stacked sheet by contacting the lowest stacked sheet's lower surface toward the image forming unit to form an image on the second surface of the sheet;

a sheet pressing unit comprising a pressing gate in contact with the top of the sheets to be stacked in the sheet stacker applies a specified pressing force to the sheet feeding unit via the sheet;

a receiving portion provided to the sheet pressing unit receives a sheet that is next conveyed to the sheet stacker; and a driving mechanism rotates the sheet pressing unit to put the sheet received by the receiving portion for clamping the received sheet between the sheet feeding unit and the sheet pressing unit, the receiving portion receives a sheet that is next stacked in the sheet stacker.

* * * * *